United States Patent [19]

Tanabe et al.

[11] 4,286,192

[45] Aug. 25, 1981

[54] VARIABLE ENERGY STANDING WAVE LINEAR ACCELERATOR STRUCTURE

[75] Inventors: Eiji Tanabe, Sunnyvale; Victor A. Vaguine, Palo Alto, both of Calif.

[73] Assignee: Varian Associates, Inc., Palo Alto, Calif.

[21] Appl. No.: 84,284

[22] Filed: Oct. 12, 1979

[51] Int. Cl.[3] ..... H01J 25/10

[52] U.S. Cl. ..... 315/5.41; 315/5.42

[58] Field of Search ..... 315/5.41, 5.42

[56] References Cited

U.S. PATENT DOCUMENTS

| | | | |
|---|---|---|---|
| 3,906,300 | 9/1975 | Tran | 315/5.42 |
| 3,953,758 | 4/1976 | Tran | 315/5.41 |
| 4,004,181 | 1/1977 | Kervizic et al. | 315/5.41 |
| 4,155,027 | 5/1979 | Schriber et al. | 315/5.41 |
| 4,160,189 | 7/1979 | Tran et al. | 315/5.41 |
| 4,162,423 | 7/1979 | Tran | 315/5.41 |

*Primary Examiner*—Saxfield Chatmon, Jr.

*Attorney, Agent, or Firm*—Stanley Z. Cole; Leon F. Herbert; Edward H. Berkowitz

[57] ABSTRACT

Variable energy selection is accomplished in a side cavity coupled standing wave linear accelerator by shifting the phase of the field in a selected side coupling cavity by $\pi$ radians where such side coupling cavity is disposed intermediate groups of accelerating cavities. For an average acceleration energy of $E_1$ (MeV) per interaction cavity, and a total number of N interaction cavities, the total energy gain is $E_1(N-2N_1)$ where $N_1$ is the number of interaction cavities traversed beyond the incidence of the phase shift. The phase shift is most simply accomplished by changing the selected side cavity configuration mechanically in repeatable manner so that its resonant excitation is switched from $TM_{010}$ mode to either $TM_{011}$ or TEM modes. Thus, the total energy gain can be varied without changing the RF input power. In addition, the beam energy spread is unaffected.

12 Claims, 5 Drawing Figures

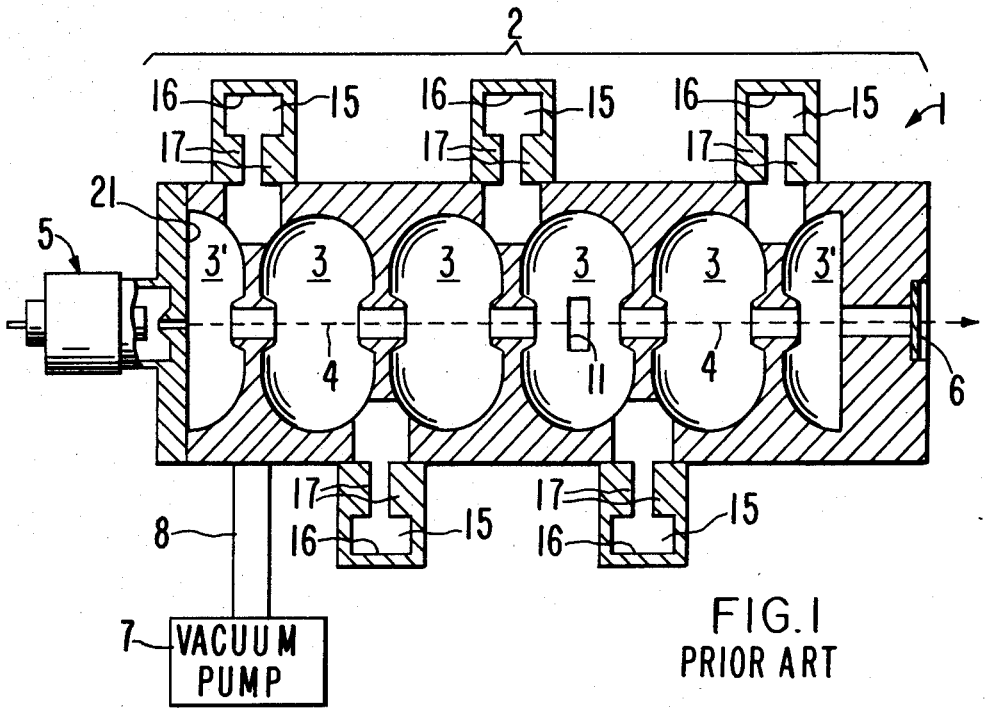
FIG. 1
PRIOR ART
FIG. 2
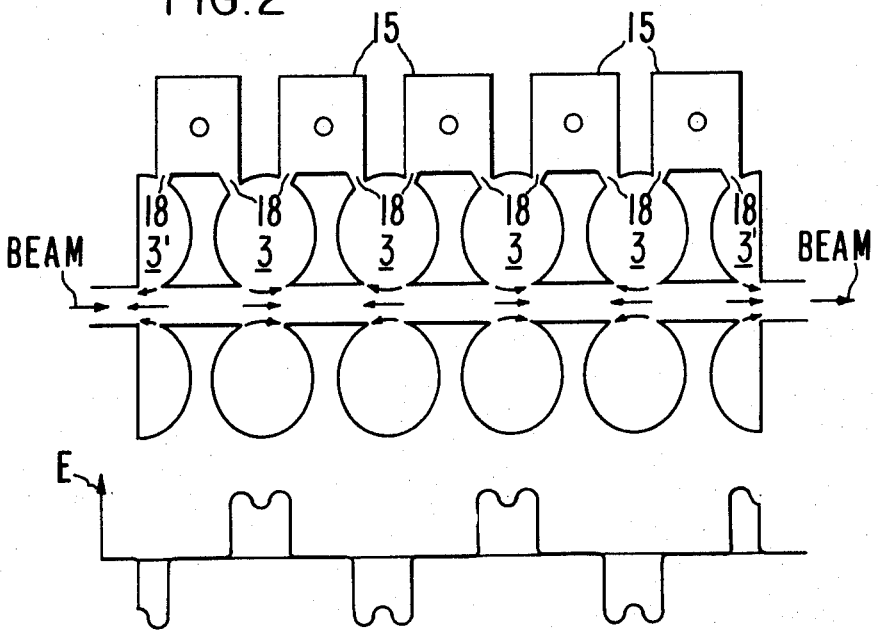

FIG.3
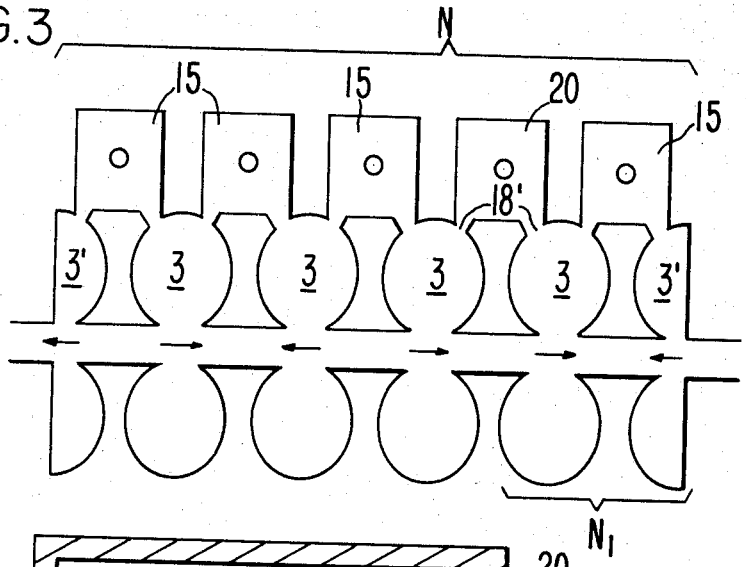
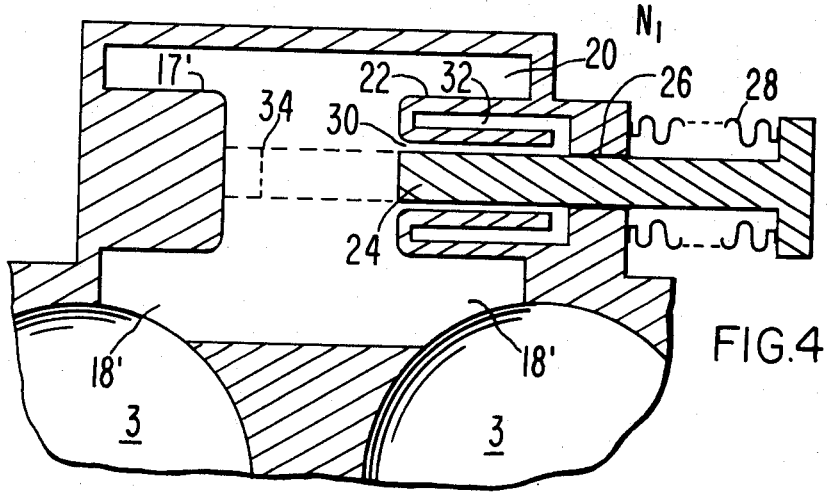
FIG.4
FIG.5
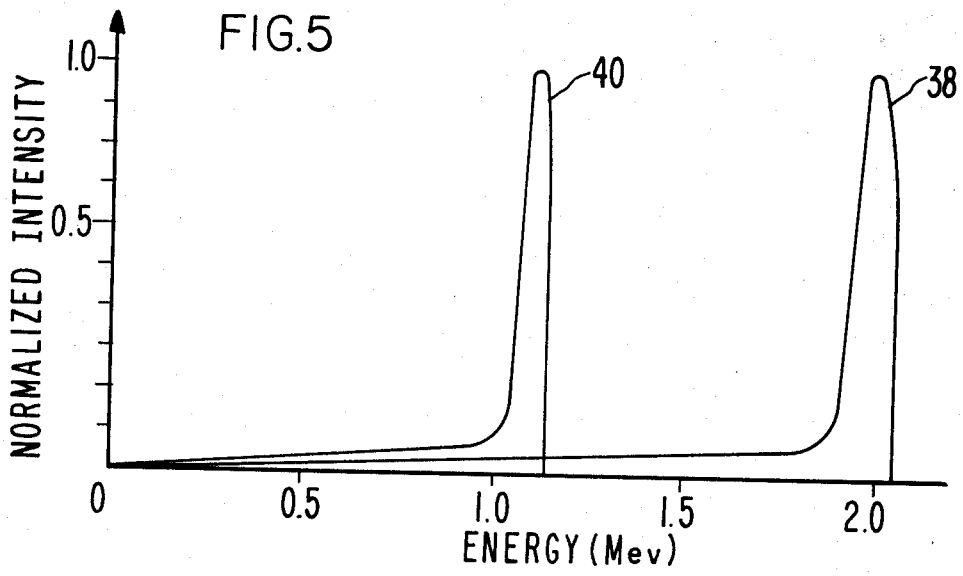

VARIABLE ENERGY STANDING WAVE LINEAR ACCELERATOR STRUCTURE

DESCRIPTION

1. Field of the Invention

The invention relates to linear accelerators adapted to provide charged particles of variable energy.

2. Background of the Invention

It is very desirable to obtain beams of energetic charged particles with a narrow spread of energy, such energy being variable over a wide dynamic range. Moreover it is desirable that the spread of energy, $\Delta E$ be independent of the value of the accelerated final energy E.

One straightforward approach to accomplishing variable energy control in a linear accelerator is to vary the power supplied from the RF source to the accelerating cavities. The lower accelerating electric field experienced by the beam particles in traversing the accelerating cavities results in lower final energy. A variable attenuator in the wave guide which transmits rf power between the source and accelerator can provide such selectable variation in the amplitude of the accelerating electric field. This approach suffers from a degradation in the beam quality of the accelerated beam due to an increased energy spread $\Delta E$ in the final beam energy. The dimensions of the accelerator can be optimized for a particular set of operating parameters, such as beam current and input rf power. However, that optimization will not be preserved when the rf power is changed because the velocity of the electrons and hence, the phase of the electron bunch relative to the rf voltages of the cavities is varied. The carefully designed narrow energy spread is thus degraded.

Another approach of the prior art is to cascade two traveling wave sections of accelerator cavities. The two sections are independently excited from a common source with selectable attenuation in amplitude and variation in phase applied to the second section. Such accelerators are described by Ginzton, U.S. Pat. No. 2,920,228, and by Mallory, U.S. Pat. No. 3,070,726, commonly assigned with the present invention. These traveling-wave structures are inherently less efficient than side-coupled standing-wave accelerators because energy that is not transferred to the beam must be dissipated in a load after a single passage of the rf wave energy through the accelerating structure and also shunt impedance is lower than in side-coupled standing-wave accelerators.

Still another accelerator of the prior art described in U.S. Pat. No. 4,118,653 issued Oct. 3, 1978 to Victor Aleksey Vaguine and commonly assigned with the present invention, combined a traveling-wave section of accelerator, producing an optimized energy and energy spread, with a subsequent standing-wave accelerator section. Both the traveling-wave and standing wave sections were excited from a common rf source with attenuation provided for the excitation of the standing-wave section. In the standing-wave portion of the accelerator there is little effect on the accelerated and bunched beam for which the velocity is very close to the velocity of light and therefore substantially independent of the energy. However, this scheme requires that two greatly different types of accelerator section must be designed and built, and also complex external microwave circuitry is required.

Another standing-wave linear accelerator exhibiting variable beam energy capability is realized with an accelerator comprising a plurality of electromagnetically decoupled substructures. Each substructure is designed as a side-cavity coupled accelerator. The distinct substructures are coaxial but interlaced such that adjacent accelerating cavities are components of different substructures and electromagnetically decoupled. Thus adjacent cavities are capable of supporting standing waves of different phases. The energy gain for a charged particle beam traversing such an accelerator is clearly a function of the phase distribution. For an accelerator characterized by such interleaved substructures, maximum beam energy is achieved when adjacent accelerating cavities differ in phase by $\pi/2$, the downstream cavity lagging the adjacent upstream cavity, and the distance between adjacent accelerating cavities is $\frac{1}{4}$ the distance traveled by an electron in one rf cycle. Adjustment of the phase relationship between substructures results in variation of beam energy. Such an accelerator is described in U.S. Pat. No. 4,024,426 issued May 17, 1977 to Victor A. Vaguine and commonly assigned with the present invention. While it provides good efficiency and energy control, the structure is more complex than the present invention.

SUMMARY OF THE INVENTION

It is an object of the present invention to provide a standing-wave linear accelerator producing accelerated particles of variable energy while maintaining excellent uniformity in energy spread of the beam over the dynamic range of acceleration.

This object is accomplished in a side coupled standing-wave accelerator structure by providing an adjustable variation of pi radians in the phase shift in a selected side cavity of the accelerator.

In one feature of the invention energy gained by the accelerated beam is varied by selecting the side cavity or cavities in which the phase shift is accomplished.

In another feature of the invention the desired phase shift is accomplished by changing the excitation of the selected side cavity from $TM_{010}$ mode to $TM_{011}$ or TEM mode.

FIG. 1 is a schematic cross section of a side-cavity coupled standing-wave accelerator of the prior art.

FIG. 2 is a sketch of the electric field orientation in the accelerator of FIG. 1.

FIG. 3 is a sketch of the electric field orientation in an accelerator embodying the invention.

FIG. 4 is a schematic cross section of an adjustable side cavity useful in an accelerator embodying the invention.

FIG. 5 is a graph of the beam energy distributions produced by an embodiment of the invention.

DETAILED DESCRIPTION OF THE INVENTION

The prior-art accelerator 1 includes an accelerating section 2 having a plurality of cavity resonators 3 successively arranged along a beam path 4 for electromagnetic interaction with charged particles within the beam for accelerating the charged particles to nearly the velocity of light at the downstream end of the accelerator section 2. A source of beam particles such as a charged particle gun 5 is disposed at the upstream end of the accelerator section 2 for forming and projecting a beam of charged particles, as of electrons, into the accelerator section 2. A beam output window 6, which is permeable to the high energy beam particles and impermeable to gas, is sealed across the downstream end of the accelerator section 2. The accelerator section 2 and the gun 5 are evacuated to a suitably low pressure as of $10^{-6}$ torr by means of a high vacuum pump 7 connected into the accelerator section 2 by means of an exhaust tubulation 8.

The accelerator section 2 is excited with microwave energy from a conventional microwave source, such as a magnetron, connected into the accelerator section 2, for example, by means of a waveguide (not shown) delivering energy into one of the resonators 3 via an inlet iris as indicated at 11. The accelerator section 2 is a standing-wave accelerator, i.e., a resonant section of coupled cavities, and the microwave source delivers approximately 1.6 megawatts to the accelerator section 2. In a common embodiment the microwave source is chosen for S-band operation and the cavities are resonant at S-band. The resonant microwave fields of the accelerator section 2 electromagnetically interact with the charged particles of the beam 4 to accelerate the particles to essentially the velocity of light at the downstream end of the accelerator. More particularly, the 1.6 megawatts of input microwave power produce output electrons in the beam 4 having energies of the order of 4 MeV. These high energy electrons may be utilized to bombard a target to produce high energy X-rays or, alternatively, the high energy electrons may be employed for directly irradiating objects, as desired.

A plurality of coupling cavities 15 are disposed off the axis of the accelerator section 2 for electromagnetically coupling adjacent accelerating cavities 3. Each of the coupling cavities 15 includes a cylindrical side wall 16 and a pair of centrally disposed inwardly projecting capacitive loading members 17 projecting into the cylindrical cavity from opposite end walls thereof to capacitively load the cavity. Each cylindrical coupling cavity 15 is disposed such that it is approximately tangent to the interaction cavities 3 with the corners of each coupling cavity 15 intersecting the inside walls of the accelerating cavities 3 to define the magnetic field-coupling irises 18 providing electromagnetic wave energy coupling between the accelerating cavities 3 and the associated coupling cavity 15. The interaction cavities 3 and the coupling cavities 15 are all tuned to essentially the same frequency.

In FIG. 2 the upper sketch schematically represents the prior art accelerator of FIG. 1. The upper sketch of FIG. 2 illustrates the directions of rf electric field at one instant of maximum electric field as shown by the arrows in the gaps of interaction cavities 3. The lower sketch is a graph of electric field intensity along the beam axis 4 (FIG. 1) at the instant in time shown in the upper sketch. In operation, the gaps are spaced so that electrons (with velocity approaching the velocity of light) travel from one gap to the next in $\frac{1}{2}$ rf cycle, so that after experiencing an accelerating field in one gap they arrive at the next when the direction of the field there has been reversed, to acquire additional acceleration. The field in each side cavity 15 is advanced in phase by $\frac{1}{2}\pi$ radians from the preceding interaction cavity 3 so the complete periodic resonant structure operates in a mode with $\pi/2$ phase shift per cavity. Since the beam does not interact with side cavities 15, it experiences the equivalent of a structure with $\pi$ phase shift between adjacent interaction cavities. When the end cavities are accelerating cavities as shown, the essentially standing-wave pattern has very small fields (represented by O's) in side cavities 15, minimizing rf losses in these non-working cavities. In FIGS. 1 and 2 the end cavities 3' are shown as half-cavities. This improves the beam entrance conditions and provides a perfectly symmetrical resonant structure with uniform fields in all accelerating cavities.

It is convenient to assign an average energy increment $E_1$ to each accelerating cavity and for an accelerator structure of N complete accelerator cavities, the optimum tuning will yield a final energy of $E=NE_1$.

The adjustment of the phase shift between a single pair of adjacent accelerating cavities is employed in the present invention to achieve a selectable energy for the final beam up to the maximum achievable energy. Turning now to FIG. 3, a structure, otherwise similar to that of FIG. 2, is distinguished by providing the capability to alter the phase shift between adjacent accelerating cavities 3 by changing the phase of the standing wave in a selected side cavity 20. In a preferred embodiment, the phase shift introduced between adjacent interaction cavities is changed from $\pi$ to 0 radians and this is accomplished by switching the operation of the selected side cavity from a $TM_{010}$ mode in which the magnetic field is in the same phase at both coupling irises 18 in FIGS. 1 and 2 to a $TM_{011}$ or TEM mode, in which modes there is a phase reversal between irises 18' in FIGS. 3 and 4.

As a consequence it will be observed that the electric field encountered by the beam will no longer be phased for maximum acceleration in the remaining traversed cavities but will actually be in a decelerating phase. The net accelerating energy will then be $E=(N-2N_1)E_1$, where $N_1$ is the number of cavities beyond the phase reversal.

The switching of phase is accomplished by altering the resonant properties of the selected side cavity 20. A schematic illustration of a switching side cavity is presented in FIG. 4. The switching side cavity is in the form of a coaxial cavity 20 with reentrant capacative loading posts 17' and 22 projecting from the end walls. Cavity 20 is coupled to the adjacent interaction cavities 3 by irises 18'. In the $TM_{010}$ mode the greatest electric field is along the axis. A metallic rod 24 is slidably mounted inside hollow loading post 22. Rod 24 is guided by a bearing 26 and connected to a flexible metallic bellows 28 to permit axial motion in the vacuum. An rf connection of rod 24 to loading post 22 is provided by a double quarter-wave choke 30, 32 which eliminates high currents across bearing 26. When rod 24 is positioned as shown in solid lines in FIG. 4, cavity 20 is tuned to the same resonant frequency of its $TM_{010}$ mode as the resonant frequency of the interaction accelerating cavities 3. To change the mode pattern rod 24 is mechanically pushed inward (as indicated in dashed lines) from its position (shown in solid lines) inside hollow loading post 22, thereby increasing the capacitive loading and lowering the resonant frequencies of the original $TM_{010}$ mode. In accordance with the invention, rod 24 is moved inwardly to a position such that the cavity 20 is no longer resonant, in the $TM_{010}$ mode, at the resonant frequency of the interaction cavities 3, and instead operates in the $TM_{011}$ or TEM mode where such modes are resonant at the same frequency as the resonant frequency of the interaction cavities.

In one embodiment, the dimensioning of cavity 20 is chosen so that at a certain position 34 of the left end of rod 24, the $TM_{011}$ resonance is at the operating frequency of the interaction cavities 3. There is then again a $\pi/2$ radian phase shift from the preceding interaction cavity 3 to coupling cavity 20 and another $\pi/2$ between coupling cavity 20 and the following accelerating cavity 3. However, the magnetic field reversal inside cavity 20 (as a result of operating in the $TM_{011}$ mode) provides another $\pi$ radians shift, so the net coupling between adjacent interaction cavities 3 is at 2 $\pi$ or 0 radians shift instead of the $\pi$ radians provided by the other coupling cavities 15.

In another embodiment switching cavity 20 is dimensioned so that when rod 24 is pushed clear across cavity 20 to contact loading post 17' the TEM mode resonance (the half-wavelength resonance of a coaxial line with short-circuited ends) occurs at the operating frequency of the interaction cavities 3. In this mode there is also a reversal of magnetic field between ends of the coupling cavity, so the phase of the coupling between adjacent interaction cavities 3 is changed from $\pi$ radians to 2 $\pi$ or 0 radians shift as described above. As will be understood by those skilled in the art, the optimized configuration of the side cavity 20 for switching from the $TM_{010}$ mode to the TEM mode is different from the optimized configuration of the side cavity for switching from the $TM_{010}$ mode to $TM_{011}$ mode.

FIG. 5 shows plots of the calculated energy spectra of a single acceleration section of 1 full accelerating cavity, 2 half cavities (initial and final) and 2 side coupling cavities. These spectra are obtained by integrating the accelerations of electrons interacting with the sinusoidally oscillating standing-wave electric fields in the cavities. Such calculated spectra have been found to accurately reproduce measured spectra. Spectral function 38 presents such a spectrum for normal operation ($TM_{010}$). Curve 40 presents the spectrum obtained upon mode switching of the side cavity coupling the full accelerating cavity and the final half accelerating cavity.

The number of coupling cavities in which the phase is reversed is determined by the desired reduction in particle energy. Of course multiple steps of energy can be obtained by having a plurality of phase-reversing coupling cavities. If, for example, one had a reversing switch cavity 20 between the last whole interaction cavity of FIG. 3 and the final half-cavity, combined with another between the last two whole interaction cavities, one could produce four values of output energy by combinations of the two switches.

The foregoing will be understood to be descriptive of an exemplary embodiment of the invention and therefore not to be interpreted in a limiting sense; accordingly the actual scope of the invention is defined by the appended claims and their legal equivalents.

We claim:

1. In a particle accelerator, a resonant acceleration circuit comprising at least three cavities having substantially the same resonant frequencies and electromagnetically coupled in sequence, a first and third of said cavities comprising holes through their walls for passage of a beam of particles and for coupling electromagnetic energy to said beam, a second cavity coupled to each of said first and third cavities, but uncoupled from said beam, the improvement comprising: means for changing the resonant mode pattern in said second cavity to provide a change in phase of the wave energy coupled from said first cavity to said third cavity.

2. The accelerator of claim 1 wherein the means for changing the resonant mode pattern changes the phase shift between said first and third cavities by $\pi$ radians.

3. The accelerator of claim 1 wherein said second cavity is disposed away from said beam.

4. The accelerator of claim 1 wherein said first and third cavities have a common wall.

5. The accelerator of claim 1 wherein said coupling between said second cavity and said first and third cavities is by irises located in regions of high radio-frequency magnetic field.

6. The accelerator of claim 1 wherein said second cavity is a coaxial cavity and said means for changing mode pattern comprises means for varying the length of a center conductor.

7. The accelerator of claim 6 wherein said length of said center conductor is adjustable to form a continuous conductor across said coaxial cavity.

8. A particle accelerator comprising at least three interaction cavities having holes through their walls for passage of a beam of particles and for coupling electromagnetic energy to said beam, at least two coupling cavities each coupled to two of said interaction cavities, and means for selectively changing the resonant mode pattern in two of said coupling cavities to provide a change in phase of the wave energy in the coupled interaction cavities.

9. The accelerator of claim 1 wherein said means for changing said resonant mode pattern comprises means for changing a first resonant mode in said second cavity to a different mode which reverses the magnetic field in said second cavity and which is resonant at substantially the same frequency as said first mode.

10. The accelerator of claim 1 wherein said means for changing the mode pattern changes the mode between the $TM_{010}$ mode and the $TM_{011}$ mode.

11. The accelerator of claim 1 wherein said means for changing the mode pattern changes the mode between the $TM_{010}$ mode and the TEM mode.

12. The accelerator of claim 1 wherein said coupling between said three cavities is by a first iris between said first and second cavities and a second iris between said second and third cavities, said means for changing said resonant mode pattern comprises means for changing a first mode in said second cavity to a different mode which is resonant at substantially the same frequency as said first mode, one of said modes having an electromagnetic field pattern which is in the same phase adjacent both said first and second coupling irises, and the other of said modes having an electromagnetic field pattern which has one phase adjacent one of said irises and a reversed phase adjacent the other of said irises.

* * * * *